US005136306A

United States Patent [19]

Yoshimizu et al.

[11] Patent Number: 5,136,306

[45] Date of Patent: Aug. 4, 1992

[54] THERMAL TRANSFER PRINTING APPARATUS WITH MOVABLE INK TRANSFER PULLING MEANS

[75] Inventors: Toshikazu Yoshimizu, Suita; Kenji Fujita, Toyonaka; Takashi Seigenji, Minoo, all of Japan

[73] Assignee: Ricoh Company, Ltd., Tokyo, Japan

[21] Appl. No.: 551,463

[22] Filed: Jul. 12, 1990

[30] Foreign Application Priority Data

Jul. 14, 1989 [JP] Japan ..... 1-183003
Jan. 31, 1990 [JP] Japan ..... 2-23410

[51] Int. Cl.[5] ..... B41J 2/32
[52] U.S. Cl. ..... 346/76 PH
[58] Field of Search ..... 346/76 PH

[56] References Cited

U.S. PATENT DOCUMENTS 4,887,096 12/1989 Asakura et al. ..... 346/76 PH
4,918,461 4/1990 Murakami ..... 346/76 PH

FOREIGN PATENT DOCUMENTS 25781 2/1985 Japan .
57356 3/1986 Japan .
0068279 4/1986 Japan ..... 346/76 PH
62-30074 2/1987 Japan .
161583 7/1987 Japan .
236672 10/1988 Japan .

*Primary Examiner*—Mark J. Reinhart
*Attorney, Agent, or Firm*—Cooper & Dunham

[57] ABSTRACT

A thermal transfer printing apparatus that comprises a thermal head, an ink transfer medium having an ink layer, a printing medium to which the ink is to be transferred, a platen for pressing the ink transfer medium together with the printing medium against the thermal head. The thermal head comprises a substrate, a plurality of heating elements disposed on a surface of the substrate close to an end of the substrate and two electrode lines connected to each of the plurality of heating elements and formed on the substrate. Each line extends from each heating element toward a direction opposite to the substrate end with respect to the heating elements. The apparatus further comprises a pulling out unit for separating and pulling out the ink transer medium from the printing medium after passing over a position of the heating elements and a direction change mechanism for changing direction of the ink transfer medium pulled out by the pulling out unit with respect to the surface of the substrate.

9 Claims, 10 Drawing Sheets

THERMAL TRANSFER PRINTING APPARATUS WITH MOVABLE INK TRANSFER PULLING MEANS

BACKGROUND OF THE INVENTION

1. Field of the Invention

The present invention relates to a thermal transfer printing apparatus used for a facsimile system and/or various kind of printers.

2. Description of the Related Art

A typical thermal printer comprises a thermal head having a plurality of heating elements disposed thereon, an ink transfer medium having a thermal transfer ink layer coated thereon, a printing medium such as a printing paper to which the ink is to be transferred and a platen. The platen urges the paper against the thermal head through the ink medium to print an image on the paper by the heating elements.

The ink transfer medium comprises a base substrate made from a polyester film which has a smooth surface. Therefore, the ink surface transferred to the paper becomes smooth and glossy, which is called "gloss printing".

Such printers can not take off the gloss from the ink surface of the printed paper. Therefore, the apparatus is not capable of making the ink surface mat and not glossy, i.e., of "mat printing".

Also, in such printing apparatus the ink transfer medium and the printing medium are conveyed while contacting over some distance after they are pressed against the thermal head by the platen to transfer the ink from the transfer medium to the printing medium. Therefore, in some occasions, the ink printed on the paper is removed and reattached to the ink medium side during the conveyance of the paper and the ink medium after the ink is printed on the paper at the thermal head, which could lower the transfer efficiency of the ink and degrade the printing quality.

SUMMARY OF THE INVENTION

It is therefore an object of the present invention to provide a thermal transfer printing apparatus which is convertible to operate either in a gloss printing mode or a mat printing mode.

Another object of the present invention is to provide a thermal printing apparatus which increases the transfer efficiency of the ink and improves the printing quality by avoiding reattachment of the ink back from the printed paper to the ink medium during the conveyance of the paper along with the ink medium.

The objects of the present invention mentioned above can be achieved by a thermal printing apparatus comprising: a thermal head which comprises a substrate having a main surface and a plurality of heating elements disposed on the surface of the substrate along an edge thereof, the elements comprising a common electrode which extends toward the side opposite to the edge of the substrate and a plurality of selective electrodes which also extend to the side opposite to the edge of the substrate; a pressing unit for pressing an ink transfer medium and a printing medium superposed on the transfer medium against the thermal head; a pick out direction changing unit for changing the direction of picking out the printing medium after the ink is transferred thereto within a range from the pressing unit side to the opposite side thereof with respect to the main surface of the substrate.

In accordance with the present invention, the thermal head is constructed as an end type thermal head wherein the picking out direction of the printing medium can be changed, which makes it possible to vary the time period from the time of heating the ink transfer medium by the heating elements to the time of separating the printing medium from the transfer medium.

Therefore, an advantage of the above mentioned thermal transfer printing apparatus is that it becomes possible to selectively carry out a gloss printing operation or a mat printing operation by one unit of apparatus in such a way that gloss printing is achieved by increasing the time period from heating the ink medium to separation of the medium from the paper while mat printing is achieved by decreasing that time period.

The objects of the present invention mentioned above can also be achieved by a thermal transfer printing apparatus comprising: a substrate having a main surface; a thermal head which comprises a plurality of heating elements disposed at an edge of the main surface of the substrate, each electrode of the heating elements and the common electrode thereof extending toward a direction opposite to the edge of the substrate; and a pressing unit for pressing an ink transfer medium and a printing medium superposed on the ink transfer medium against the thermal head, wherein the ink transfer medium is separated from the printing medium at the edge of the substrate.

In accordance with the structure of the thermal head of the present invention, the heating elements are disposed along and in the vicinity of the edge of the substrate. Therefore, by separating the ink transfer medium from the printing medium at the edge of the substrate, it becomes possible to separate the ink medium from the printing paper shortly after the ink medium is heated by the thermal head. Accordingly, the ink medium is separated from the printing medium before the ink is cooled and solidified by heating radiation after the ink layer of the medium is heated and molten, which increase the reliability of the ink transfer and the attachment of the ink to the printing medium. This is because the bonding force between the molten ink layer surface and the printing medium surface becomes greater than that between the ink layer surface and the ink medium base surface. More precisely, the temperature distribution is formed in such a manner that the ink transfer medium base has the highest temperature since the base is located nearest to the heating elements which are the only heat source, followed by the ink layer, the printing medium and the platen in this order. Also, when the molten ink is cooled, the temperature is lowered from the printing medium side to the ink medium base side. Therefore, the solidification of the ink starts from the printing medium side in the ink layer. As a result, separating the ink transfer medium from the printing medium before the molten ink layer is solidified in the boundary between the ink layer and the printing medium, as described above in accordance with the present invention, ensures greater bonding force between the ink layer and the printing medium than between the ink layer and the ink medium base. As a result, the ink is reliably transferred and attached to the printing medium side.

Further objects and advantages of the present invention will be apparent from the following description of the preferred embodiments of the invention as illustrated in the accompanying drawings.

Figure 9:
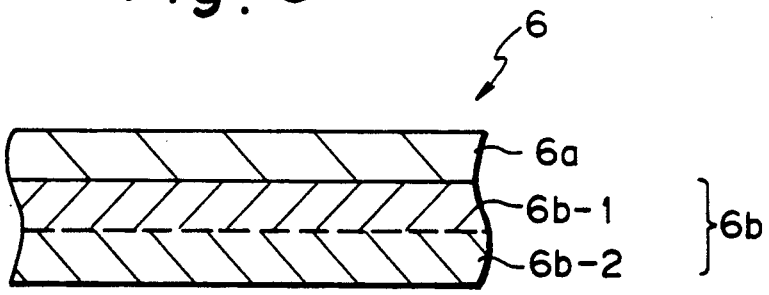
Figure 10:
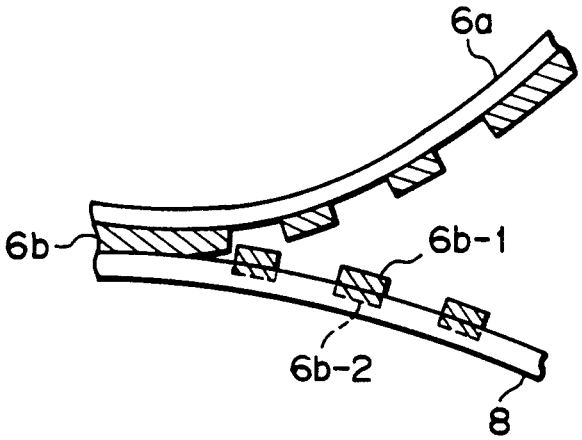
Figure 11:
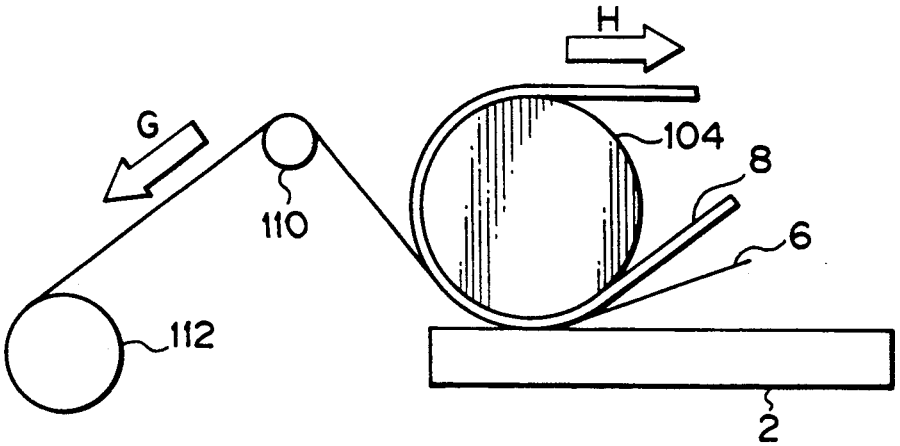
Figure 12:
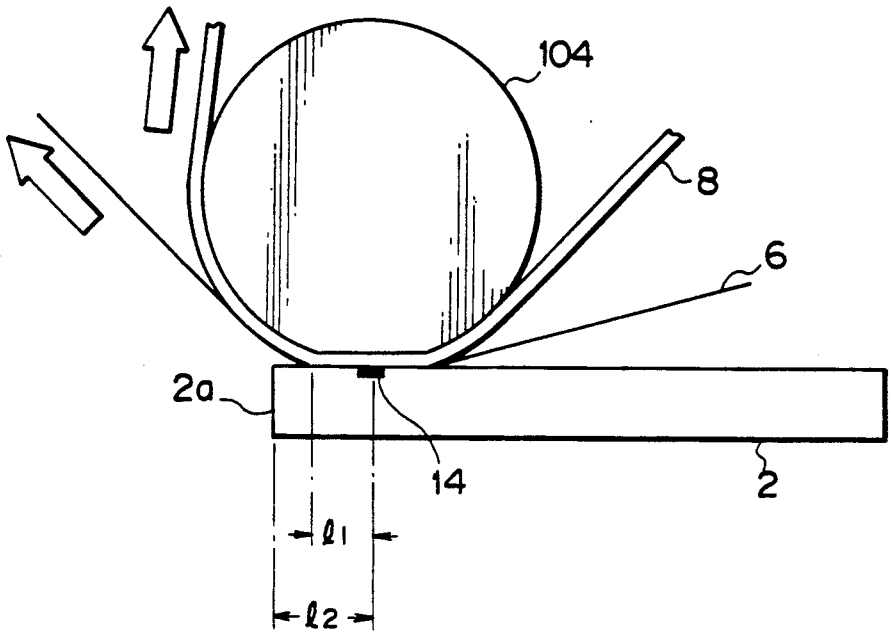
Figure 13:
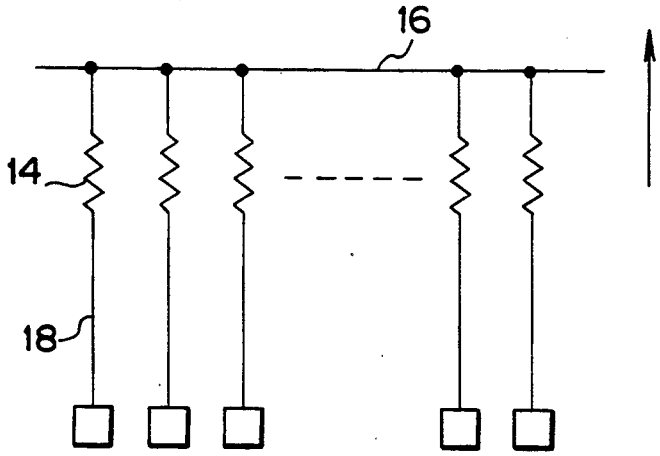
Figure 14:
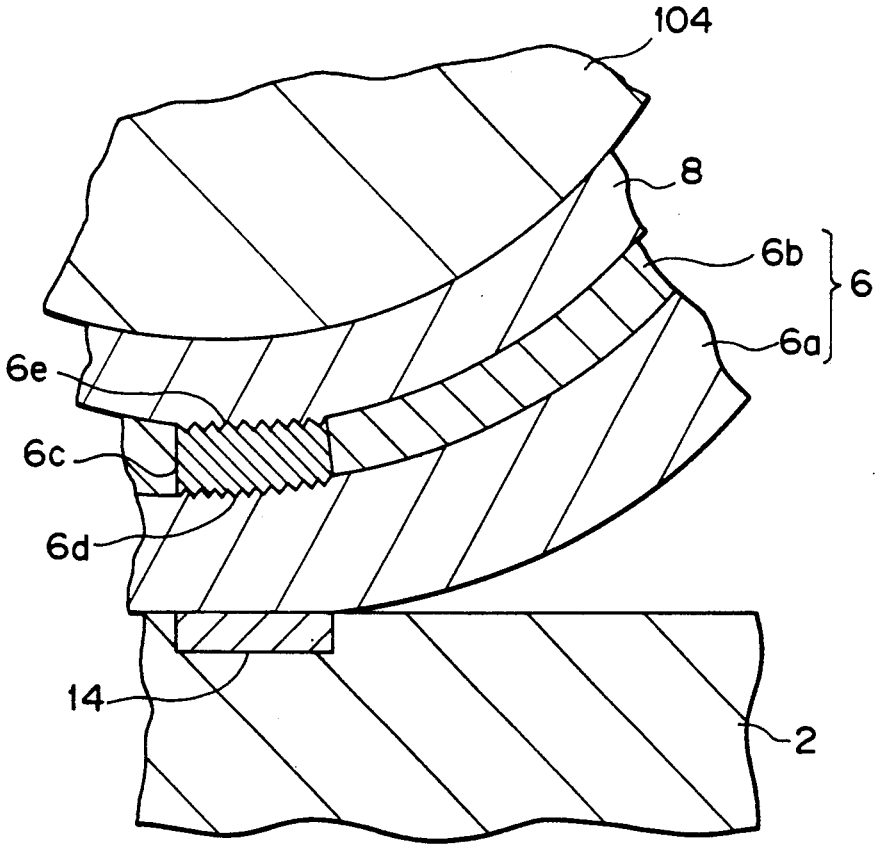
Figure 15:
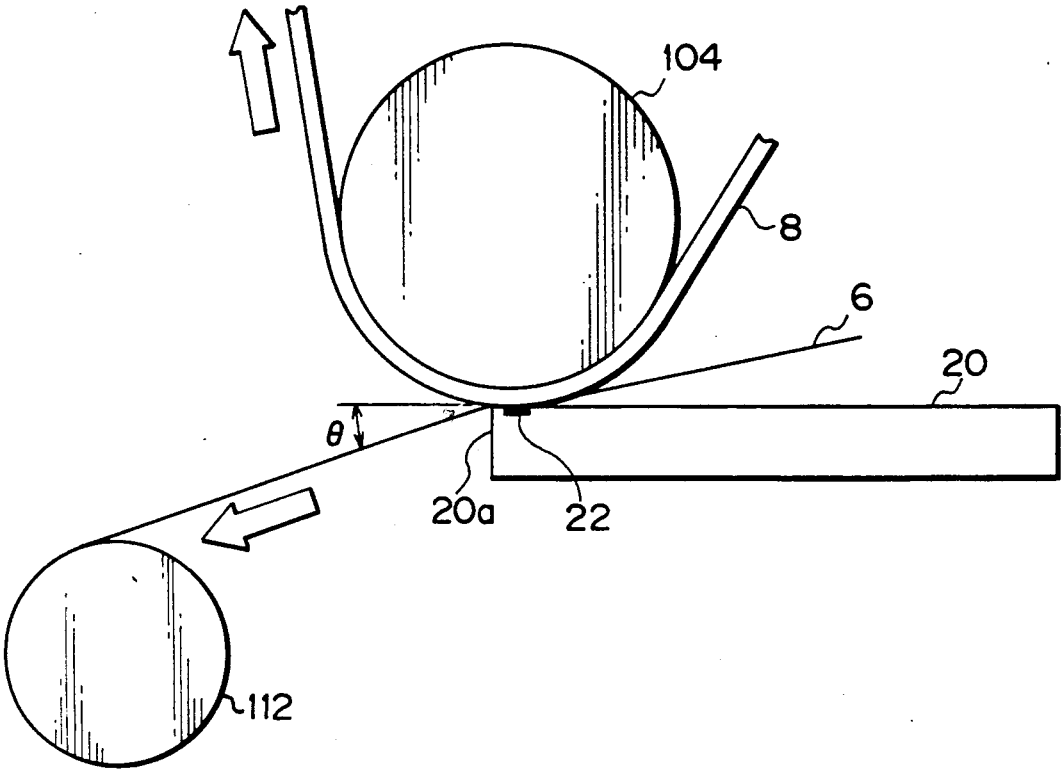
Figure 16:
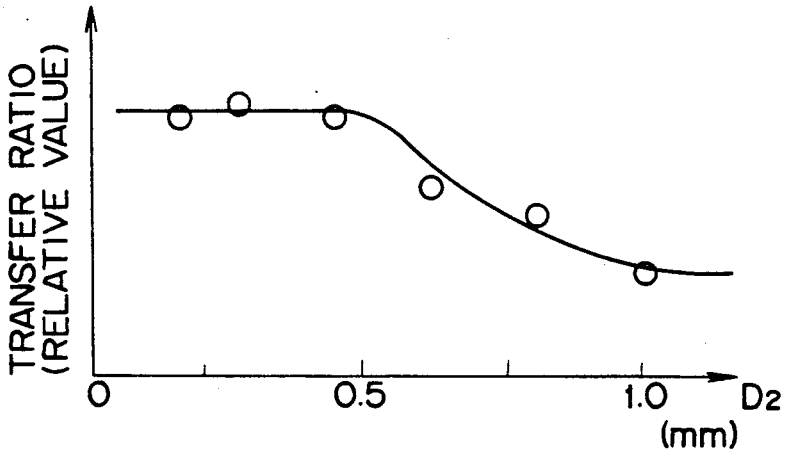

FIG. *7a* is a plan view of a heating element in accordance with another embodiment of the present invention;

FIG. *7b* is a plan view of a heating element in accordance with another embodiment of the present invention;

FIG. *8a* illustrates a thermal transfer printing apparatus in accordance with another embodiment of the present invention, FIG. *8b* illustrates the printing apparatus of FIG. *8a*, representing a gloss printing mode operation;

FIG. 9 is a sectional view of an example of an ink transfer medium having a structure suitable for the mat printing mode operation;

FIG. 10 is an explanatory view for explaining the ink transfer function of the medium of FIG. 9;

FIG. 11 illustrates a thermal transfer printing apparatus in accordance with the related art;

FIG. 12 illustrates a main portion of the thermal transfer printing apparatus of FIG. 11;

FIG. 13 is a circuit diagram of the heating elements and electrodes of the thermal head in accordance with the related art;

FIG. 14 is an explanatory view for explaining the ink transfer function in accordance with the related art;

FIG. 15 illustrates a thermal transfer printing apparatus in accordance with a further embodiment of the present invention; and FIG. 16 is a graph of the transfer ratio with respect to the distance between the edge of the thermal head substrate and the heating element.

DESCRIPTION OF THE PREFERRED EMBODIMENTS

Embodiments of the present invention are described hereinafter with reference to the drawings and in comparison to the related art which is also illustrated in the drawings.

Figure 1:
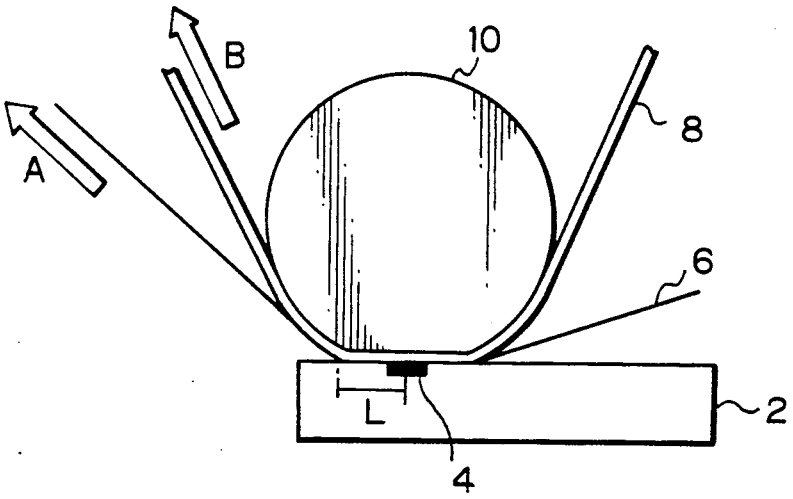
FIG. 1 illustrates a prior art thermal transfer printing apparatus.

FIG. 1 illustrates an example of a thermal transfer printing apparatus.

Numeral 2 designates a thermal head on which heating elements 4 are disposed in a row (perpendicular to the drawing sheet) along an edge of the thermal head. Numeral 10 designates a platen that presses an ink transfer medium 6 and a printing medium 8 against the thermal head 2. The ink transfer medium 6 and the printing medium 8 are superposed and are conveyed in the directions represented by arrows A and B, respectively, in accordance with the rotation of the platen 10.

The thermal head of FIG. 1 is a flat type thermal head in which a common electrode (not shown) is arranged in the left end of the thermal head substrate so that the common electrode is connected to every heating element 4 to supply an electric power thereto and in which selection electrodes for selecting the heating elements are formed on the substrate in the opposite side of the common electrode with respect to the row of the heating elements 4. The common electrode has to be relatively wide so as to supply a large amount of current sufficient for all of the heating elements 4. Therefore, the length between the left edge of the substrate and the heating element 5 becomes 2.5 to 3 mm with respect to the thermal head for A4 standard sheet or B4 standard sheet. In this case, when the ink transfer medium 6 and the printing medium 8 are pressed against the thermal head 2 by the platen 10, the width of pressed portion, i.e., the length L from the center of the heating element 4 to the end of the pressed portion of the ink transfer medium 6 and the printing medium 8, becomes about 1 mm. This means that the ink transfer medium 6 and the printing medium 8 are in contact with each other along at least the length of 1 mm right after the printing function by the heating elements 4. In this contacting state, the molten ink layer is cooled and solidified and then the ink layer is separated from the base of the ink transfer medium 6 and transferred to the printing medium 8.

The base of the ink transfer medium 6 is usually made from a polyester film which has a smooth surface. Therefore, the ink surface transferred to the printing medium 8 becomes smooth. That is, the image printed on the printing medium 8 is represented as a gloss printing image.

An embodiment of the present invention is described below. The structure of the embodiment makes it possible to change the printing operation mode between a gloss printing mode and a mat printing mode.

Figure 2:
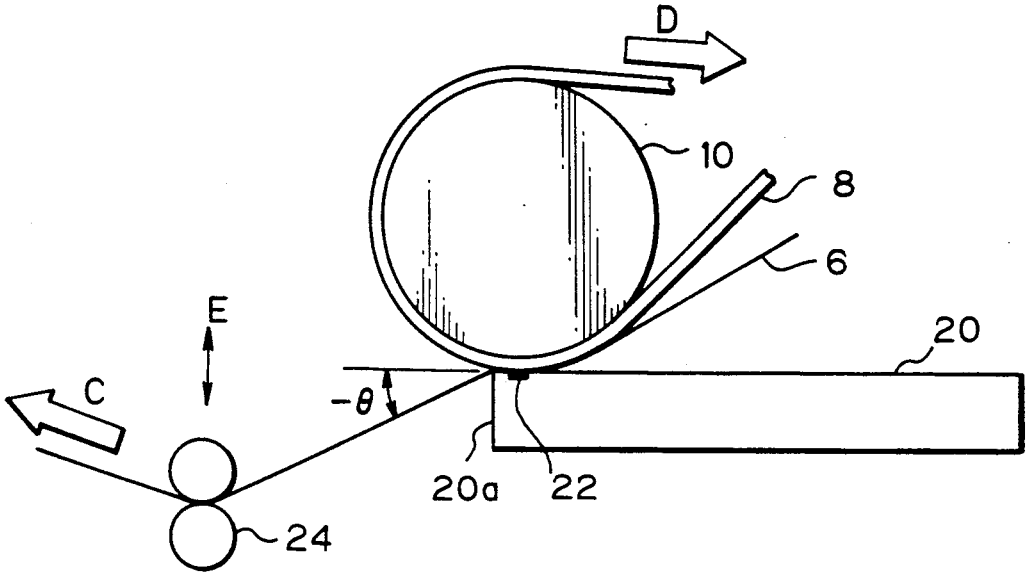
FIG. 2 illustrates a thermal transfer printing apparatus in accordance with the present invention, representing a mat printing mode operation.
Figure 3:
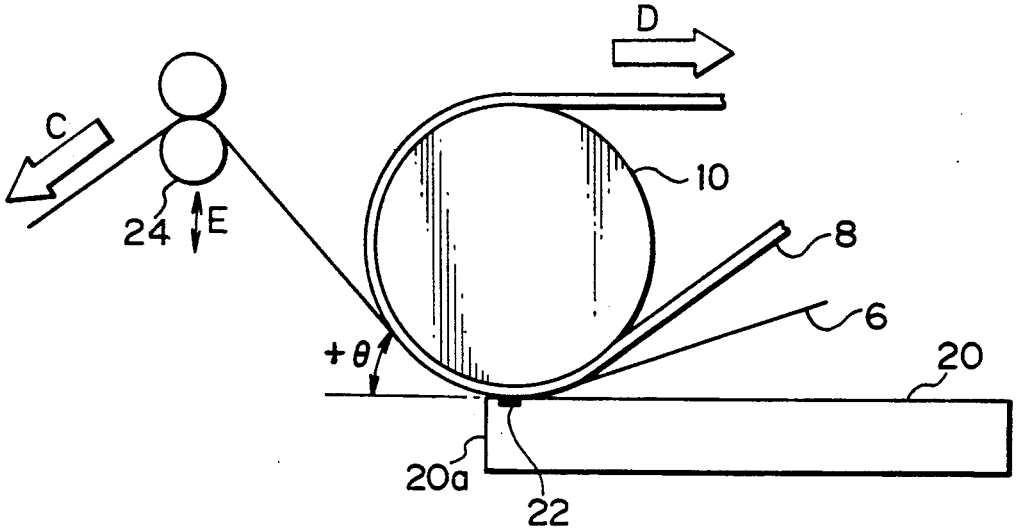
FIG. 3 illustrates the apparatus of FIG. 2, representing a gloss printing mode operation.

FIGS. 2 and 3 illustrate an embodiment of the present invention. FIG. 2 represents the mat printing mode. FIG. 3 represents the gloss printing mode.

Numeral 20 designates an edge type thermal head comprising a substrate on which heating elements 22 are arranged in a row along and in the close vicinity of an end 20*a* of the substrate in a direction perpendicular to the drawing sheet. A common electrode (not shown) for supplying an electric power to the heating elements 22 is formed on the substrate extending from the elements 22 toward the opposite side of the end 20*a* with respect to the row of the heating elements 22 (rightward in the drawing). Selection electrodes (not shown) for selecting the heating elements 22 respectively to be energized according to the image to be printed are also formed on the substrate. The selection electrodes also extend from the heating elements 22 toward the opposite direction of the end 20*a* with respect to the row of the elements 22 as well as the common electrode.

The ink transfer medium 6 and the printing medium 8 are pressed against the thermal head 20 by the platen 10 where the ink transfer medium 6 and the printing medium 8 are superposed so that the printing operation is carried out by melting the ink layer of the ink transfer medium 6 and transferring the molten ink to the printing medium 8. The ink transfer medium 6 and the printing medium 8 are conveyed in the directions represented by arrows C and D, respectively, by the rotation of the platen 10. The printing medium 8 is conveyed along the periphery of the platen 10 while the ink transfer medium 6 is separated from the printing medium 8 after the printing operation at the edge of the thermal head 20 and conveyed to a take-up reed unit (not shown).

A roller unit 24 is arranged for determining the direction of pulling out the ink transfer medium 6. The roller unit 24 is mounted on a support (not shown) which is vertically movable as shown by an arrow E and can be positioned at any vertical location so that the medium 6 is separated from the medium 8 in the direction determined by the location of the roller unit 24.

More precisely, the roller nit 24 makes it possible to set the direction of the pulling out the ink transfer medium 6 separated from the printing medium 8 either in a range below the surface of the thermal head substrate (−74 side), i.e., the opposite side of the platen 10 with respect to the substrate surface as illustrated in FIG. 2 or in a range above the surface of the thermal head substrate ($+\theta$ side), i.e., the same side as the platen 10 with respect to the substrate surface as illustrated in FIG. 3.

A concrete structure of the thermal head 20 in accordance with the embodiment of the present invention is described hereinafter in detail with reference to FIGS. 4 and 5.

Figure 4:
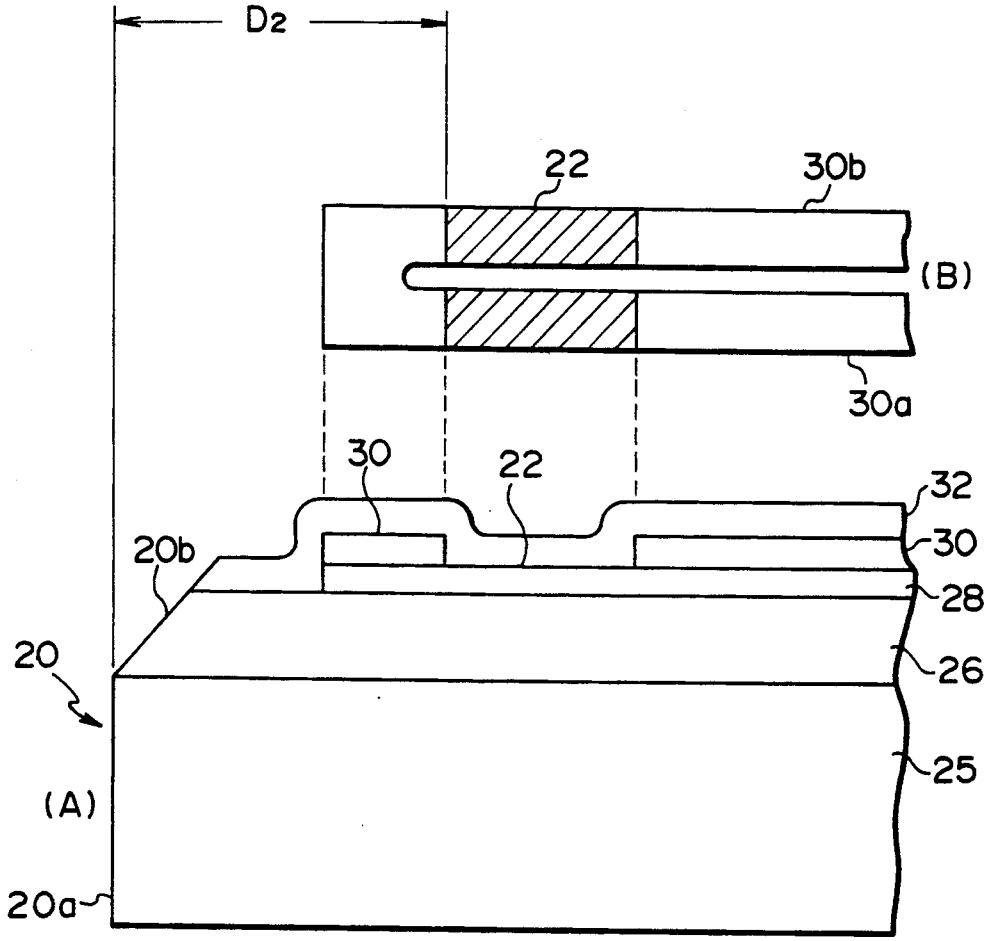
FIG. 4 is an explanatory view of a main portion of a thermal head in accordance with an embodiment of the present invention.

FIG. 4 illustrates an edge portion of the thermal head 20 where the heating elements are disposed.

Numeral 25 designates a ceramic substrate the surface of which is coated with a glazed layer 26 made from glass material. The substrate 25 may be made from metal coated with polyimide instead of ceramic. A resistance layer 28 is formed on the glazed layer 26. An electrode layer 30 is formed on the resistance layer 28. The layers 28 and 30 are patterned to form a heating element 22 and electrodes 30*a* and 30*b*, as illustrated in (B) of FIG. 4, representing a plan view thereof. The heating element 22 is composed of two resistances patterned as strips connected together through the electrode layer and constitutes one bit of heating element. One of the electrodes, e.g., the electrode 30*a* is used as a common electrode while the other electrode 30*b* is used as a selection electrode. The electrodes 30*a* and 30*b* and the heating element 22 are coated with a protection film 32.

A chamfer 20*b* is formed at the end 20*a* of the substrate on which the heating elements 22 are formed.

Examples of material of each part of the thermal head 20 are as follows.

The resistance layer 28 which constitutes the heating element 22 is made from resistance material of Ta (tantalum) group such as $Ta_2N$ or $TaSiO_2$. The thickness of the layer 28 is about from several hundreds Å to 1μm, for example a film of NiCr having a thickness of about 500 Å and a film of Au having a thickness of about 8000 Å stacked on the NiCr film.

The protection layer 32 is made from $Si_3N_4$, SiC, $Ta_2O_5$, $SiO_2$ or $SiO_2$-$Ta_2O_5$.

It is to be noted that the present invention is not limited to the above mentioned examples of material and thickness of each part of the structure.

Figure 5:
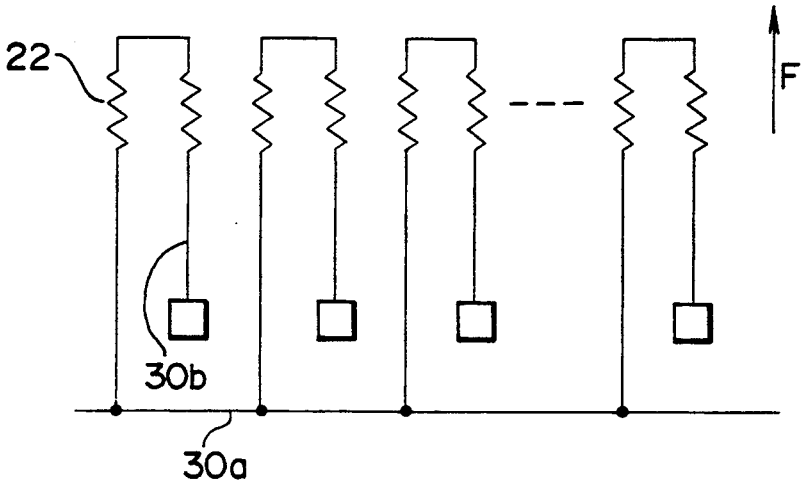
FIG. 5 is a circuit diagram of the heating elements disposed in the thermal head in accordance with an embodiment of the present invention.

FIG. 5 illustrates an example of circuit diagram of the edge type thermal head in accordance with the embodiment of the present invention.

The electrodes 30*a* and 30*b* are disposed in a side opposite to the substrate end 20*a* with respect to the row of the heating elements 22. This makes it possible to form the heating elements 22 in the close vicinity of the end 20*a* of the substrate. Therefore, it becomes possible to reduce the length D2 (FIG. 4) between the substrate end 20*a* and the element end to 500 μm or less. The arrow F in FIG. 5 designates the direction of conveying the ink transfer medium and the printing medium.

The function of the above mentioned structure of the thermal head is described hereinafter with reference to FIGS. 2 and 3.

In the mat printing mode operation, the roller unit 24 is positioned at a location below the substrate surface so that the direction of pulling out the ink transfer medium 6 after the printing operation is angle of $-\theta$ with respect to the substrate surface, as illustrated in FIG. 2.

Figure 6:
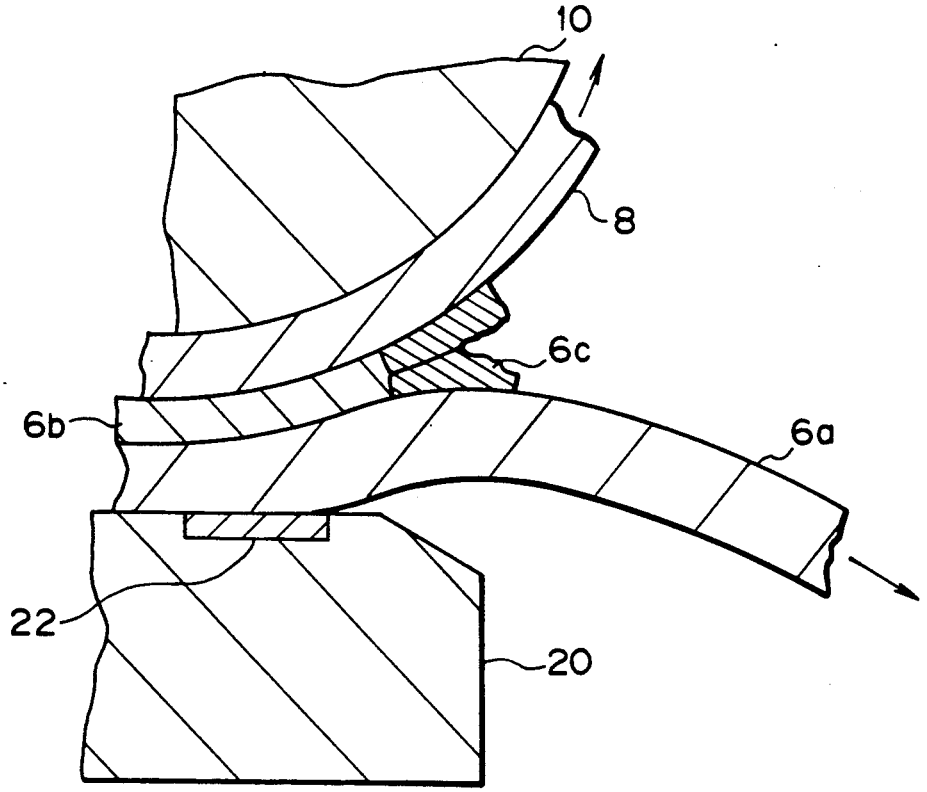
FIG. 6 is an explanatory view for explaining the mat printing mode operation, representing an enlarged view of the main portion of the thermal head of the present invention.

The function of the thermal head operated in the mat printing mode is described below with reference to FIG. 6.

The ink transfer medium 6 is heated by the heating element 22 to melt the heated portion of the in layer 6*b* of the medium 6 and transfer it to the printing medium 8. Right after the ink is transferred to the medium 8 side, the ink transfer medium 6 is separated from the printing medium 8, which means that the medium 6 is separated from the medium 8 before the heated ink layer 6*c* is fully solidified in the cooling and solidification process. Therefore, the medium 6 is separated when the ink layer 6*c* comprises a solidified layer at the side close to the medium 8 and an unsolidified layer at the side close to the medium 6. Accordingly, the surface of the ink transferred to the medium 8 becomes rough and forms a mat printing image. In the drawing, 6*a* designates a base of the ink transfer medium 6.

On the other hand, when the thermal head is to be operated in the gloss printing mode, the roller unit 24 is shifted upward and positioned at a location above the substrate surface of the thermal head 20 so that the direction of pulling out the ink transfer medium 6 is angle of $+\theta$ with respect to the substrate surface, as illustrated in FIG. 3. In this operation mode, the time period from the time when the ink layer is heated by the element 22 and transferred from the medium 6 to the medium 8 to the time when the medium 6 is separated from the medium 8, that is the time period during which the ink transfer medium 6 and the printing medium 8 are conveyed together, laminated next to each other, becomes longer than that of the operation mode of FIG. 2. Therefore, the molten ink is fully cooled and solidified during this time period of conveying mediums 6 and 8 in contact with each other. Accordingly, the ink layer is separated from the base 6*a* of the transfer medium 6 after being solidified. The surface of the base 6*a* tends to be plane and smooth, which tends to make the surface of the ink transferred to the printing medium 8 smooth and glossy, forming a gloss printing image.

As mentioned above, in accordance with the thermal head structure of the present invention, it becomes possible to change the operation mode between the mat printing mode and the glass printing mode by shifting the roller unit 24 in the vertical direction as illustrated in FIGS. 2 and 3.

Figure 7A:
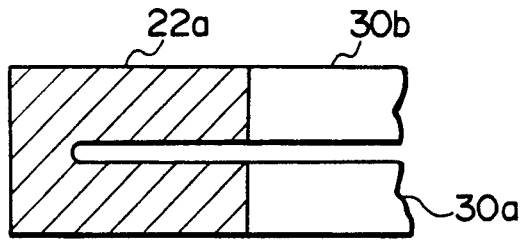
Figure 7B:
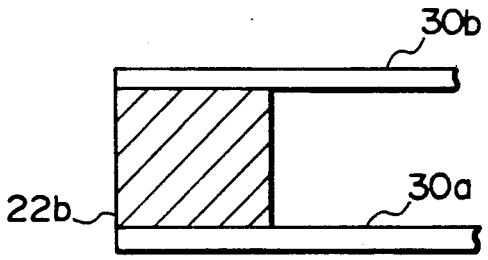

FIGS. 7*a* and 7*b* illustrate further examples of the heating element, respectively.

The shape of the heating element 22 is not limited to that of FIG. 4. FIG. 7*a* illustrates an example of the heating element 22*a* which is formed as a U-shaped element. FIG. 7*b* illustrates another example of the heating element 22*b* which is rectangular and is formed between and connected to the electrodes 30*a* and 30*b*. It is to be stressed that in any case, the common electrode 30*a* and the selection electrode 30*b* extend in the same direction from each of the heating elements 22, 22*a* and 22*b*.

In accordance with the above mentioned embodiment of the edge type thermal head of the present invention in which the heating elements are disposed in close proximity to the edge of the thermal head substrate, it becomes possible to press the thermal head surface against the platen 10 such that the surface is inclined with respect to the tangential line of the platen surface instead of being coincident with the tangential line as illustrated in FIG. 2. The inclination angle of the thermal head surface with respect to the tangential line of the platen can be adjusted in accordance with the desired printing function and quality of the printed product.

In accordance with the embodiment illustrated in FIGS. 2 and 3, the printing mode is changed by changing the vertical position of the roller unit 24. However, it is possible to change the printing mode by changing the vertical position of the thermal head 20 and the platen 10 while maintaining the position of the roller unit 24 unchanged vice versa.

Figure 8A:
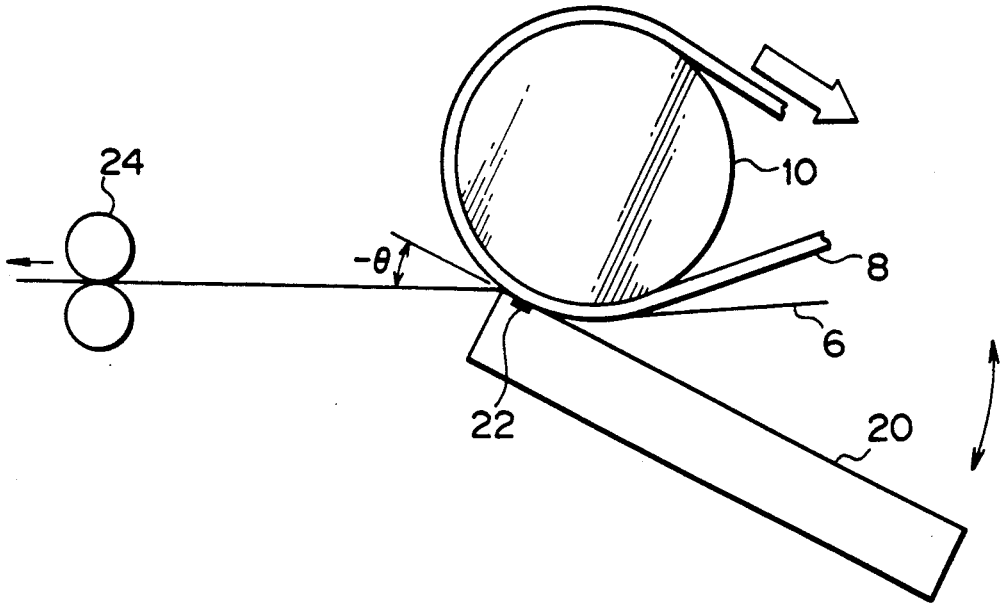
Figure 8B:
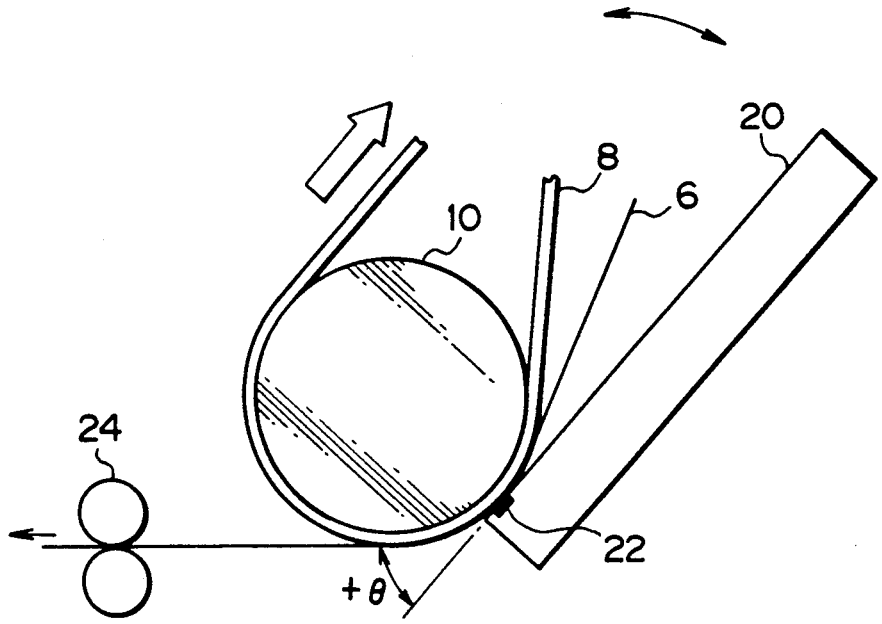

FIGS. 8*a* and 8*b* illustrate another embodiment of the present invention.

This embodiment is arranged in such a way that the angle of the assembly of the platen 10 and the thermal head 20 with respect to the roller unit 24 can be changed while the position of the roller unit 24 is maintained unchanged. FIG. 8*a* a mat printing mode operation corresponding to that of FIG. 2. Whereas, FIG. 8*b* represents a gloss printing mode operation corresponding to that of FIG. 3.

FIG. 9 illustrates a sectional view of an example of the ink transfer medium which is capable of reliably and efficiently transferring the ink to the printing sheet and especially suitable for mat printing mode operation. FIG. 10 illustrates a functional state of transferring the ink from the transfer medium of FIG. 9 to a printing medium.

As illustrated in FIG. 9, the ink transfer medium 6 comprises a base film 6*a* and a double-layered ink layer 6*b* which is composed of a low melting point ink layer 6*b*-1 disposed in the base film side in contact therewith and a high melting point ink layer 6*b*-2 disposed in the side facing to the printing medium 8.

The printing function of the medium 6 of FIG. 9 is as follows.

When the medium 6 is heated by the heating elements of the thermal head, both ink layers 6*b*-1 and 6*b*-2 melt. After that, as the medium 6 is cooled down, the ink layer 6*b*-2 which is in contact with the printing medium 8 is solidified earlier than the ink layer 6*b*-1. The medium 6 is separated from the medium 8 while the ink layer 6*b*-2 is solidified but the ink layer 6*b*-1 is not yet solidified. As a result, the solidified ink layer 6*b*-2 is reliably secured to the medium 8.

In accordance with the above mentioned ink transfer operation, the molten ink layer 6*b*-1 is separated from the base film 6*a* of the medium 6 before the layer 6*b*-1 is solidified, and as a result the surface of the transferred ink layer 6*b*-1 become rough even though the surface of the base film 6*a* is smooth. Therefore, mat printing is achieved.

FIG. 11 illustrates another example of the thermal transfer printing apparatus.

Numeral 2 designates a thermal head which has an upper main surface on which a plurality of heating elements (not shown) are formed in a row in a direction perpendicular to the drawing sheet. Numeral 104 designates a platen which urges a ink transfer medium 6 and a printing medium 8 against the heating elements of the thermal head 2 so that the ink is molten and transferred from the medium 6 to the medium 8 to perform a printing operation. After the ink is transferred from the medium 6 to the medium 8, the mediums 6 and 8 are conveyed as designated by the arrows G and H, respectively. A guide roller 110 is disposed at a position above the thermal head surface, i.e., in the same side as the platen 104 with respect to the thermal head surface. The medium 6 is rolled up by a spool 112 through the guide roller 110.

FIG. 12 illustrates a partial enlarged view of the thermal head portion of FIG. 11.

The thermal head 2 is a flat type thermal head which comprises a substrate on which heating elements 14 are disposed along an end 2*a* of the substrate. Also, on the substrate is formed a common electrode connected to all of the heating elements 14 for supplying electric power to every heating element along the end 2*a* and between the end 2*a*and the row of elements 14. Further, on the substrate is formed selection electrodes for selecting desired elements 14 in the opposite side of the end 2*a* with respect to the row of elements 14.

FIG. 13 illustrates a circuit diagram of the heating elements 14 of FIG. 12, mentioned above. Numerals 16 and 18 designate the common electrode and the selection electrode, respectively. The mediums 6 and 8 are conveyed in the direction designated by an arrow in FIG. 13.

The width of the common electrode 16 (designated by l2 in FIG. 12) is about 2.5 to 3 mm for the thermal head used for A4 or B4 standard size paper. When the mediums 6 and 8 are pressed against the thermal head 2 by the platen 104, the width of the pressed portion (the length l1 from the center of the element 14 to the end of the pressed portion in the side of the end 2*a*) becomes 1 mm. Therefore, the mediums 6 and 8 are in contact with each other for the length of at least 1 mm after the ink is printed from the medium 6 to the medium 8 at the portion of element 14.

FIG. 14 illustrates a further enlarged view of the portion where the heating element 14 is disposed.

The ink transfer medium 6 comprises a base film 6*a*and an ink layer 6*b* laminated with the film 6*a*. The printing medium 8 is superposed on the ink layer 6*b* of the medium 6. The mediums 6 and 8 are pressed against the thermal head 2 by the plates 104 such that the base film 6*a* of the medium 6 faces to and comes in contact with the heating element 14 of the thermal head 2. A portion 6*c* of the ink layer 6*b* which portion is heated by the element 14 is molten and transferred to the medium 8.

As mentioned before with reference to FIG. 12, the mediums 6 and 8 are conveyed together while in contact with each other over a distance of at least 1 mm. Therefore, in some occasions, the molten ink layer 6*c* is cooled and solidified during the conveyance over this 1 mm. If the ink layer 6*c* is solidified, the bonding force between the layer 6*c* and the base film 6*a* becomes strong and the layer 6*c* could become reattached to the base film 6*a*. As a result, when the medium 6 is separated from the medium 8, the ink layer 6*c* may not be transferred to the medium 8 but may remain on the base film 6*a* of the medium 6 instead, which could lower the transfer ratio of ink and reduce the reliability of printing operation. In other words, assuming that the bonding force of the boundary 6d between the ink layer 6c to be transferred and the base film 6a is represented by F2 and that the bonding force of the boundary 6e between the ink layer 6c and the medium 8 is represented by F1, if F2 becomes stronger than F1 due to the solidification of the layer 6c before the separation of the medium 6 from the medium 8, the ink layer 6c remains on the base film 6a of the medium 6 instead of being transferred to the medium 8.

The above mentioned problem can be obviated by an embodiment of the present invention described hereinafter.

FIG. 15 illustrates the structure of the embodiment of the thermal transfer printing apparatus in accordance with the present invention.

Numeral 20 designates an edge type thermal head comprising a substrate having an upper main surface on which a plurality of heating elements 22 are formed in a row perpendicular to the drawing sheet and along and in close vicinity of an edge 20a of the thermal head substrate.

An ink transfer medium 6 and a printing medium 8 are pressed against the thermal head 20 by a platen 104 so that the ink of the medium 6 is heated and transferred from the medium 6 to the medium 8 by the heating elements 22 of the thermal head 20.

The medium 6 is rolled up by a spool 112 after the ink is transferred to the medium 8. The spool 112 is disposed at a position below the thermal head surface, i.e., in the opposite side of the platen 104 with respect to the thermal head surface on which the heating elements are formed. After the ink is transferred from the medium 6 to the medium 8, the medium 6 is separated from the medium 8 at the edge of the end 20a of the thermal head 20 and rolled up by the spool 112.

In the embodiment mentioned above, the guide roller 110 provided in the structure of FIG. 11 is deleted. The edge of the thermal head 20 functions as the guide roller instead. Therefore, it becomes possible to make the structure compact and small and reduce the cost of the apparatus.

The structure and arrangement of the heating elements of the thermal head in accordance with the embodiment of FIG. 15 are substantially the same as those of FIG. 4.

Also, the circuit structure of the heaing elements of the thermal head is substantially the same as that of FIG. 5.

FIG. 16 illustrates a graph of ink transfer ratio of the thermal head in accordance with the present invention in relation to the distance D2 which represents in FIG. 4 the distance between the end 20a of the thermal head and an end of the element 22 in the side of the end 20a. The data of the graph represents relative ink transfer ratio of a thermal head which has 8 dots of heating elements in every one mm (8 dpm) and which is operated such that one line is printed in 5 milliseconds (5 ms/line) and 8 lines are printed in every one mm (8 lines/mm). As can be seen from the graph, the transfer ratio is significantly higher when the distance D2 between the elements end and the thermal head end is 500 μm or less.

As mentioned before, in accordance with the embodiment of the present invention, the printing apparatus comprises an edge type thermal head in which heating elements are arranged in proximity close to the end of the thermal head and a pressing mechanism for pressing the ink transfer medium and the printing medium together against the thermal head, wherein the structure is arranged in such a way that the ink transfer medium is separated from the printing medium at the edge of the thermal head. Therefore, the ink transfer medium is separated from the printing medium while the ink layer of the transfer medium is still in a molten state after the layer is heated but before the layer has solidified, which makes it possible to reliably transfer the ink from the transfer medium to the printing medium and thereby increase the ink transfer ratio. Accordingly, a clear and high quality printed image can be obtained.

In comparison to the flat type thermal head as illustrated in FIG. 12, in accordance with the edge type thermal head of the present invention, the heating elements are well pressed against the thrust into the platen to make it possible to raise the ink transfer ratio even for a pulp paper having a rough surface.

Also, the printed image can be seen immediately after the image is printed since the ink transfer medium is separated from the printing medium right after the ink is transferred to the printing medium.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal transfer printing apparatus comprising:
- a substrate constituting a thermal head;
- a plurality of heating elements disposed on a surface of said substrate along and in a close vicinity of one end of said substrate;
- an ink transfer medium having an ink layer;
- a printing medium to which ink is transferred;
- a platen for pressing said ink transfer medium together with said printing medium against said heating elements of said thermal head;
- a pulling out means disposed apart from said platen for separating and pulling out said ink transfer medium from said printing medium after passing over a position of said heating elements; and
- a direction changing means for changing selectively a relative position of said pulling out means to said surface of said substrate so as to change an angle of pulling out said ink transfer medium with respect to said surface of said substrate, thereby to change a length at which said ink transfer medium and said printing medium overlap with each other on said platen.

2. A thermal transfer printing apparatus according to claim 1, wherein each of said heating elements includes two electrode lines extending in a direction opposite to said one end of said substrate with respect to said heating elements.

3. A thermal transfer printing apparatus according to claim 1, wherein said pulling out means comprises a winding means for winding said ink transfer medium onto a spool and a guiding means for guiding said ink transfer medium and defining a path of said ink transfer medium, and said direction changing means comprises a moving means for moving said guiding means upward and downward with respect to said surface of said substrate.

4. A thermal transfer printing apparatus according to claim 3, wherein said guiding means comprises a pair of rollers for putting said ink transfer medium therebetween.

5. A thermal transfer printing apparatus according to claim 1, wherein said direction changing means moves an assembly of said platen and said thermal head in a state that a position of said pulling out means is stationary in such a manner that said surface of said substrate is movable upward and downward with respect to said pulling out means.

6. A thermal transfer printing apparatus according to claim 1, wherein said direction changing means moves angularly an assembly of said platen and said thermal head in a state that a position of said pulling out means is stationary in such a manner that an angle of said surface of said substrate with respect to said pulling out means is changeable.

7. A thermal transfer printing apparatus according to claim 1, wherein said ink transfer medium comprises a base layer having a smooth surface on which said ink layer is laminated.

8. A thermal transfer printing apparatus according to claim 7, wherein said ink layer is a double layered structure having a high melting point ink layer and a low melting point ink layer, said high melting point ink layer being disposed in contact with said base layer.

9. A thermal transfer printing apparatus according to claim 1, wherein a distance on said surface of said substrate between said heating element and said one end of said substrate is about 500 μm or less.

* * * * *